US005351889A

United States Patent [19]

Whiteside

[11] Patent Number: 5,351,889

[45] Date of Patent: Oct. 4, 1994

[54] FLOW TRIPPED INJECTOR

[75] Inventor: Steven K. Whiteside, San Diego, Calif.

[73] Assignee: The United States of America as represented by the Secretary of the Navy, Washington, D.C.

[21] Appl. No.: 777,031

[22] Filed: Oct. 16, 1991

[51] Int. Cl.[5] ..... B05B 1/24

[52] U.S. Cl. ..... 239/132

[58] Field of Search ..... 239/132

[56] References Cited

U.S. PATENT DOCUMENTS

| | | | |
|---|---|---|---|
| 2,905,234 | 9/1959 | Scholz | 239/132 |
| 3,239,205 | 3/1966 | Metz | 239/132 |
| 3,408,007 | 10/1968 | Raichle et al. | 239/132 |
| 4,645,959 | 2/1987 | Dobran | 310/11 |
| 4,755,398 | 7/1988 | Buford | 427/216 |
| 4,846,113 | 7/1989 | Morgan et al. | 122/21 |
| 4,959,566 | 9/1990 | Dobran | 310/11 |

FOREIGN PATENT DOCUMENTS

| | | |
|---|---|---|
| 53-31289 | 3/1978 | Japan . |
| 2197045 | 5/1988 | United Kingdom . |

*Primary Examiner*—Michael J. Carone

*Attorney, Agent, or Firm*—Harvey Fendelman; Thomas Glenn Keough; Michael A. Kagan

[57] ABSTRACT

A turbulent flow injector includes a ceramic injector body having an outer cylindrical wall with an inner surface, an inner cylindrical wall having an inner surface, an end wall at an outlet end of the body terminating the outer and inner walls so as to define an annular cavity between the inner and outer walls. The annular cavity is open at an inlet end of the body. A duct, defined by the inner surface of the inner wall, has an inlet at the inlet end of the body. A heat conductive insert is positioned within the annular cavity and has an outer surface in thermal contact with the inner surface of the outer wall. The insert has an external section extending beyond the inlet end of the body and cooling fins extending from the external section. An annular air chamber is defined between the insert and the inner wall of the body. An important feature of the invention is a protuberance mounted at the inlet end of the body and radially extending over the inlet of the duct for inducing turbulent flow in a fluid flowing through the duct.

16 Claims, 2 Drawing Sheets

FLOW TRIPPED INJECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to a composite injector for introducing a first chemical product which becomes corrosive when heated above a certain temperature into an enclosure containing a second chemical product which when chemically combined with said first chemical product, produces a highly exothermic chemical reaction. More particularly, the invention relates to an injector suitable for introducing sulfur hexaflourine into an environment containing molten lithium.

The utilization of stored chemical energy to generate heat energy in order to power Rankine cycle power plants is well known. One such system is described in U.S. Pat. No. 4,959,566, entitled "LITHIUM-SULFUR HEXAFLUORIDE MAGNETOHYDRODYNAMIC POWER SYSTEM CONFIGURATIONS AND SYSTEM DESIGN CONSIDERATIONS," Sep. 25, 1990. Another such system is described in "LITHIUM-SULFUR HEXAFLUORIDE MAGNETOHYDRODYNAMIC POWER SYSTEM," Feb. 24, 1987.

One type of injector for introducing SF6 into an environment of liquid lithium employs a two-part assembly comprising a tungsten tube brazed within a Hastalloy housing. The SF6 flows through the tungsten tube. An air gap between the tube and the housing partially insulates the tube from the heat migrating from the lithium bath through the housing. One problem with this type of injector is that it allows too much heat to migrate into the flow path. This allows SF6 flowing though the tungsten tube disassociates into fluorines and sulfides at elevated temperatures. The fluorines attack the tungsten causing spallation of the tungsten. Once the tungsten degrades, the less capable Hastalloy quickly follows suit leaving a hole in the boiler for lithium to escape. Another failure mode is where the flame plume at the front of the injector causes the Hastalloy housing to melt away, providing a path for the lithium to surround the tungsten insert. The hot lithium further heats the SF6, causing certain failure of the tungsten insert from corrosive action by the disassociated SF6.

These problems result from the fact that metals conduct heat well and corrode rapidly at high temperatures. Another problem with metal based injectors used in conjunction with these systems is that metals have a high range of coefficients of thermal expansion. This is a problem for assemblies comprising components manufactured of different metals each having a different coefficient of thermal expansion because the components are vulnerable to cracking due to thermally induced stresses.

Therefore, there is a need for a non-metallic based injector suitable for use in an SF6/lithium power system that is more temperature and chemical resistant than would be a metallic based injector.

SUMMARY OF THE INVENTION

The present invention provides a non-metallic based turbulent flow injector suitable for use in an SF6/lithium power system that is more temperature and chemical resistant than would be a metallic based injector. The injector includes a ceramic injector body having an outer cylindrical wall with an inner surface, an inner cylindrical wall having an inner surface, an end wall at an outlet end of the body terminating the outer and inner walls so as to define an annular cavity between the inner and outer walls. The annular cavity is open at an inlet end of the body. A duct, defined by the inner surface of the inner wall, has an inlet at the inlet end of the body. A heat conductive insert is positioned within the annular cavity and has an outer surface in thermal contact with the inner surface of the outer wall. The insert has an external section extending beyond the inlet end of the body and cooling fins extending from the external section. An annular air chamber is defined between the insert and the inner wall of the body. An important feature of the invention is a protuberance mounted at the inlet end of the body and radially extending over the inlet of the duct for inducing turbulent flow in a fluid flowing through the duct.

An important advantage of the present invention is that it provides an injector that is chemically resistant to SF6 and liquid lithium at temperatures in the range of 1800°–2400° F. In one particular application of the invention, the injector is able to provide SF6 having a temperature up to about 500° F. at the duct exit, well below 950° F., the approximate disassociation temperature of SF6.

DESCRIPTION OF THE PREFERRED EMBODIMENT

Figure 1:
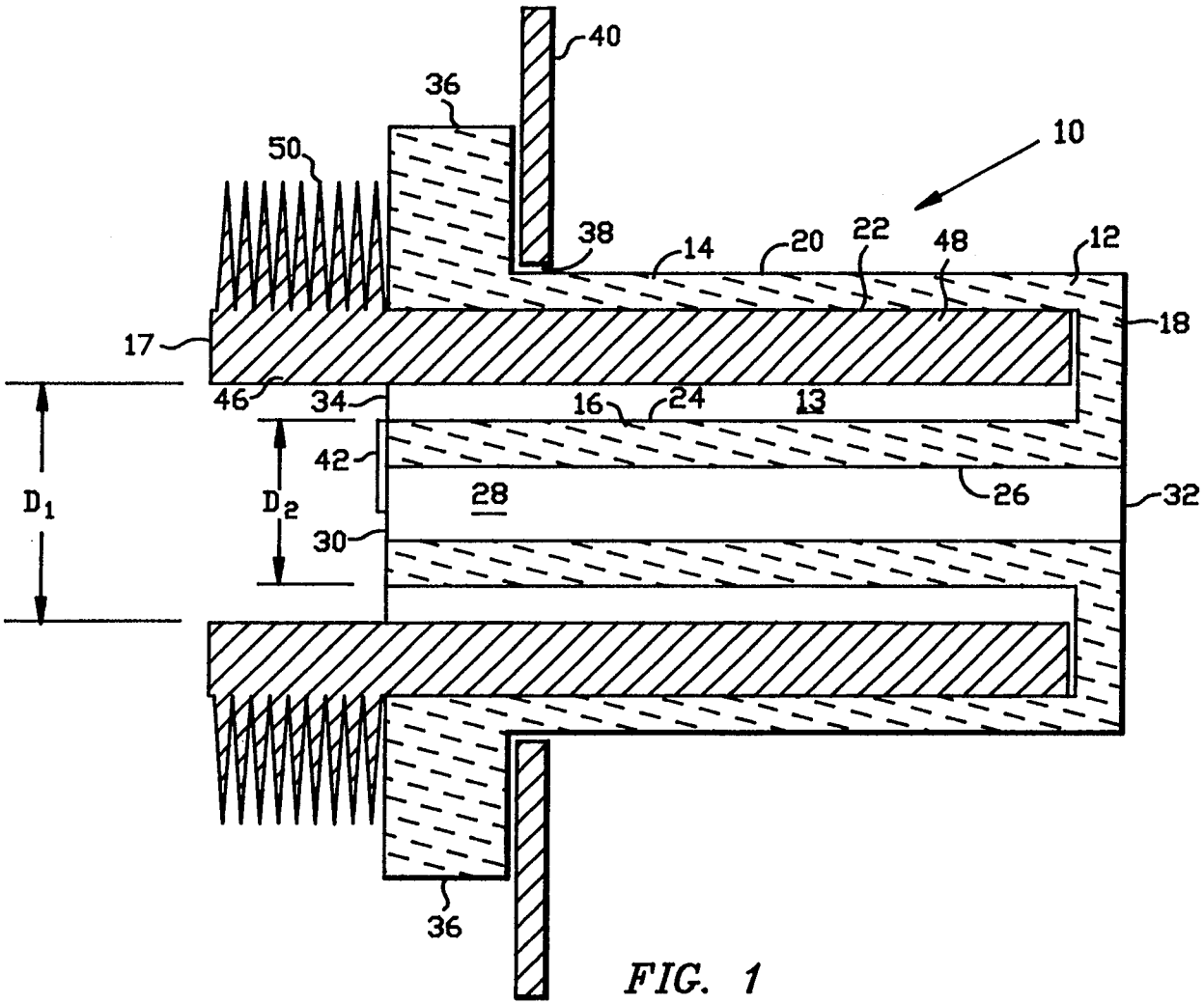
FIG. 1 is a cross-sectional view of one embodiment of the injector of the present invention.

Referring to FIG. 1, there is shown flow tripped injector 10 comprising injector body 12 and heat sink insert 17. Injector 10 has been developed for use in Rankine cycle power systems where heat is generated by injecting gas such as sulfur hexaflouride (SF6) into a high temperature boiler, as for example, one containing molten lithium. In this type of system, which is well known, the heat developed by the exothermic reaction between the SF6 and the liquid lithium is transformed into mechanical energy via a steam loop and turbine. Temperatures produced by the chemical reaction between SF6 and liquid lithium are nominally 1800° F., but can be as high as 4000°–6000° F. in the flame plume. These temperature are extremely demanding on any materials exposed to them, such as those of an injector used in such a system.

Still referring to FIG. 1, injector body 12 may be cylindrically shaped and have an annular cavity 13 defined by outer wall 14, inner wall 16, and end wall 18. Outer wall 14 has outer and inner wall surfaces 20 and 22, respectfully. Inner wall 16 has inner wall surface 24 and duct surface 26. Axial duct 28 is defined by duct surface 28 and has inlet 30 and outlet 32. Annular cavity 13 is open at end 34, opposite end wall 18. Body 12 may also include flange 36 extending radially outward from outer surface 20. Flange 36 provides a attachment surface by which body 12 may be inserted through aperture 38 and fixedly attached to boiler 40 using well known techniques, such as brazing. In the preferred embodiment, injector body 12 is manufactured from a ceramic material such as silicon nitride ($SiN_4$) or a composite zirconium based ceramic such as Lanxide 90—X—001 because ceramics have excellent resistance to high temperatures and are relatively impervious to many corrosive chemical environments. However, it is to be understood that the scope of the invention is not to be limited to injector bodies manufactured from ceramics. Other materials having the appropriate chemical and temperature properties previously mentioned above may also be used, as for example, rhenium or platinum.

Protuberance 42, preferably a stainless steel wire, may for example, be attached by brazing it to a nickel alloy plated on inner wall 16 at inlet 30 so that protuberance 42 extends radially into duct 28 for a distance equal to about half the diameter of duct 28. Techniques for plating a metal to a ceramic are practiced by Kyocera Industrial Ceramic Corporation of Aliso Viejo, Calif. By way of example, protuberance 42 may be a 0.025 inch diameter stainless steel wire, or may be fabricated of other materials capable of withstanding exposure to SF6, liquid lithium, and their products of combustion. In the preferred embodiment, the length/diameter ratio of duct 28 is around 8–10.

Figure 2:
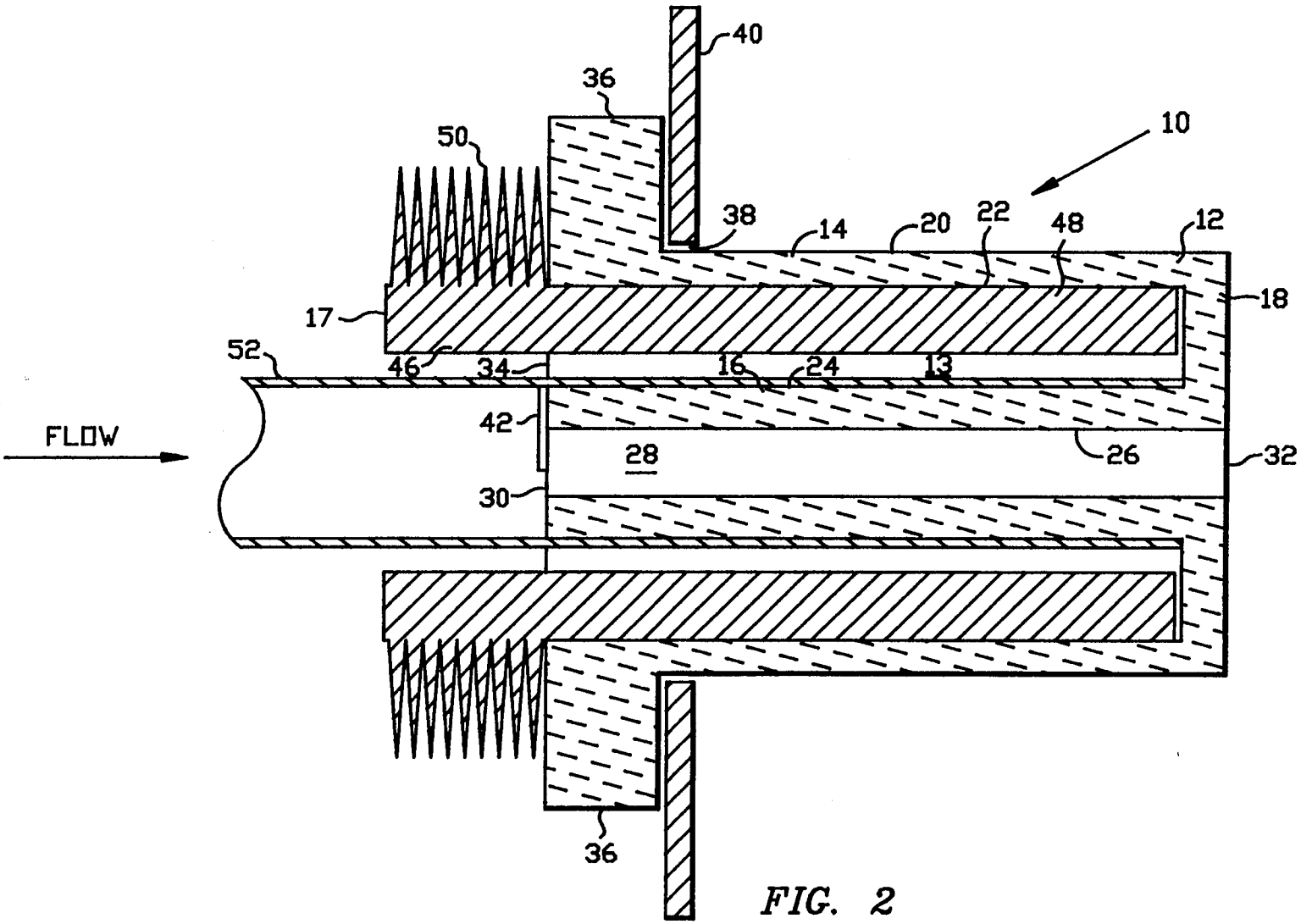
FIG. 2 is a cross-sectional view of another embodiment of the injector of the present invention.

In one example of the preferred embodiment, shown in FIG. 2, fluid is conveyed to duct 28 by stainless steel tube 52 which is brazed to nickel plated inner wall surface 24.

Heat sink insert 17, shaped as a cylindrical tube having tube wall 46, is positioned within annular cavity 13 so that outer surface 48 of wall 46 abuts inner surface 22 with an interference or close fit. Insert 17 extends beyond open end 34 where there are positioned multiple cooling fins 50. The inner diameter, $D_1$, of tube wall 46 is greater than the diameter, $D_2$, of inner wall surface 24 so as to maintain air gap 13 between insert 17 and inner wall surface 24. Heat sink insert 17 is preferably manufactured from copper because of its excellent heat conductance, although other materials such as gold/gold or silver/silver alloys may also be used. Desirable properties of the material for insert 17 are high heat conductance, low strength at high temperature, a melting temperature in excess of 1350° F., and a suitable coefficient of thermal expansion which allows the insert to fit within injector body 12 without inducing damaging stress in the injector body.

In the operation of the invention, the flow of SF6 delivered to injector 10 is interrupted by protuberance 42 so as to introduce turbulence into the SF6 as it flows through inlet 30 into duct 28. The increased turbulent flow resists laminar boundary layer heating of the SF6 along duct surface 26. This is a very important characteristic of the present invention because, although the bulk temperature of the SF6 increases the thin film temperature along duct surface 26 decreases. This maintains the entire temperature gradient of the SF6 at a level lower than the temperature at which it would disassociate in to fluorines and sulfides, i.e., about 950° F. The ability of the present invention to maintain the temperature of the SF6 below its disassociation temperature is very important because there are no materials which are known to be chemically resistant to attack by high temperature fluorine. The present invention maintains the temperature of the SF6 up to about 500° F. at the exit of duct 28.

During steady-state operation, heat migrates from the inner wall 16 towards the cooler SF6 gas flowing through duct 28. This enables heat to be diverted along the length of heat sink insert 17 dissipated off of fins 50 located outside of injector body 12. Air gap 13 provides further insulation from heat that may otherwise be transferred from injector body 12 to the SF6.

Obviously, many modifications and variations of the present invention are possible in light of the above teachings. For example, while injector 10 has been described as being suitable for application with regard to an SF6 and liquid lithium Rankine cycle power system, it is to be understood that the present invention is suitable for being employed in any application where it is desirable to reduce the average temperature of a fluid (either gas or liquid) by introducing turbulent flow into the fluid to prevent excessive localized fluid temperatures that would result from boundary value heating in a laminar flow layer. Therefore, it is to be understood that within the scope of the appended claims, the invention may be practiced otherwise than as specifically described.

I claim:

1. A turbulent flow injector, comprising:

a ceramic injector body having an outer cylindrical wall with an inner surface, an inner cylindrical wall having an inner surface, an end wall at an outlet end of said body terminating said outer and inner walls so as to define an annular cavity between said inner and outer walls, said annular cavity being open at an inlet end of said body, a duct defined by said inner surface of said inner wall and having an inlet at said inlet end of said body;

a heat conductive insert positioned within said annular cavity and having an outer surface in thermal contact with said inner surface of said outer wall, said insert having an external section extending beyond said inlet end of said body and having cooling fins extending from said external section;

an annular air chamber defined between said insert and said inner wall of said body; and a protuberance mounted at said inlet end of said body and radially extending over said inlet of said duct.

2. The injector of claim 1 wherein:

said body is chemically resistant to lithium and SF6, each at a temperature in the range of 1800°–2000° F., and has a melting temperature in excess of 2500° F.

3. The injector of claim 2 wherein:

said body is manufactured from a ceramic material.

4. The injector of claim 3 wherein:

said ceramic is made of a material selected from the group consisting of silicon nitride and a composite zirconium based ceramic.

5. The injector of claim 4 wherein:

said heat conductive material is selected from the group consisting of copper, gold/gold alloy, and silver/silver alloy

6. The injector of claim 5 wherein:

said protuberance is composed of a material selected from the group consisting of nickel, titanium, tungsten, and stainless steel.

7. The injector of claim 6 wherein:

said heat sink insert has cooling fins for transferring heat away from said insert.

8. The injector of claim 7 wherein:

said protuberance is stainless steel wire.

9. A turbulent flow injector, comprising:

a ceramic injector body having an outer cylindrical wall with an inner surface, an inner cylindrical wall having an inner surface, an end wall at an outlet end of said body terminating said outer and inner walls so as to define an annular cavity between said inner and outer walls, said annular cavity being open at an inlet end of said body, a duct defined by said inner surface of said inner wall and having an inlet at said inlet end of said body;

a heat conductive insert positioned within said annular cavity and having an outer surface in thermal contact with said inner surface of said outer wall, said insert having an external section extending beyond said inlet end of said body and having cooling fins extending from said external section;

an annular air chamber defined between said insert and said inner wall of said body; and a protuberance mounted at said inlet end of said body and radially extending over said inlet of said duct for inducing turbulent flow in a fluid flowing through said duct.

10. The injector of claim 9 wherein:

said body is chemically resistant to lithium and SF6, each at a temperature in the range of 1800°-2000° F., and has a melting temperature in excess of 2500° F.

11. The injector of claim 10 wherein:

said body is manufactured from a ceramic material.

12. The injector of claim 11 wherein:

said ceramic is made of a material selected from the group consisting of silicon nitride and a composite zirconium based ceramic.

13. The injector of claim 12 wherein:

said heat conductive material is selected from the group consisting of copper, gold/gold alloy, and silver/silver alloy.

14. The injector of claim 13 wherein:

said protuberance is composed of a material selected from the group consisting of nickel, titanium, tungsten, and stainless steel.

15. The injector of claim 14 wherein:

said heat sink insert has cooling fins for transferring heat away from said insert.

16. The injector of claim 15 wherein:

said protuberance is stainless steel wire.

* * * * *